US009746208B2

(12) United States Patent
Wu

(10) Patent No.: US 9,746,208 B2
(45) **Date of Patent: *Aug. 29, 2017**

(54) COOLING SYSTEM HAVING DUAL SUCTION PORT COMPRESSOR

(71) Applicant: Whirlpool Corporation, Benton Harbor, MI (US)

(72) Inventor: Guolian Wu, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 49 days.

This patent is subject to a terminal disclaimer.

(21) Appl. No.: 14/636,442

(22) Filed: Mar. 3, 2015

(65) Prior Publication Data

US 2015/0241098 A1 Aug. 27, 2015

Related U.S. Application Data

(63) Continuation of application No. 13/780,706, filed on Feb. 28, 2013, now Pat. No. 9,228,762.

(51) Int. Cl.
*F25B 41/04* (2006.01)
*F25B 39/02* (2006.01)
(Continued)

(52) U.S. Cl.
CPC ..... *F25B 1/00* (2013.01); *F25B 5/04* (2013.01); *F25B 39/028* (2013.01);
(Continued)

(58) Field of Classification Search
CPC ..... F25B 41/043; F25B 1/00; F25B 39/028; F25B 2400/07; F25B 5/04; F25B 1/10; F25B 2341/0662; F25D 11/022
(Continued)

(56) References Cited

U.S. PATENT DOCUMENTS 2,328,472 A 8/1943 Lehane et al.
2,593,038 A 4/1952 Lehane et al.
(Continued)

FOREIGN PATENT DOCUMENTS

EP 0624763 A1 11/1994

OTHER PUBLICATIONS

European Search Report, European Patent Application No. EP 14155436, Feb. 24, 2015, 9 pages.

*Primary Examiner* — Mohammad M Ali

(57) ABSTRACT

A cooling system for appliances, air conditioners, and other spaces includes a compressor, and a condenser that receives refrigerant from the compressor. The system also includes an evaporator that receives refrigerant from the condenser. Refrigerant received from the condenser flows through an upstream portion of the evaporator. A first portion of the refrigerant flows to the compressor without passing through a downstream portion of the evaporator, and a second portion of the refrigerant from the upstream portion of the condenser flows through the downstream portion of the evaporator after passing through the upstream portion of the evaporator. The second portion of the refrigerant flows to the compressor after passing through the downstream portion of the evaporator. The refrigeration system may be configured to cool an appliance such as a refrigerator and/or freezer, or it may be utilized in air conditioners for buildings, motor vehicles, or other such spaces.

20 Claims, 3 Drawing Sheets

(51) Int. Cl.

| | |
|---|---|
| ***F25B 1/00*** | (2006.01) |
| ***F25B 5/04*** | (2006.01) |
| ***F25D 11/02*** | (2006.01) |
| *F25B 1/10* | (2006.01) |

(52) U.S. Cl.
CPC ..... *F25B 41/043* (2013.01); *F25D 11/022* (2013.01); *F25B 1/10* (2013.01); *F25B 2341/0662* (2013.01); *F25B 2400/07* (2013.01)

(58) Field of Classification Search
USPC ..... 62/115, 525
See application file for complete search history.

(56) References Cited

U.S. PATENT DOCUMENTS

| | | | | |
|---|---|---|---|---|
| 2,976,698 | A | 3/1961 | Muffly | |
| 3,064,449 | A | 11/1962 | Rigney | |
| 4,051,691 | A | 10/1977 | Dawkins | |
| 4,259,848 | A | 4/1981 | Voigt | |
| 4,565,072 | A | 1/1986 | Fujiwara et al. | |
| 5,150,583 | A | 9/1992 | Jaster et al. | |
| 5,323,621 | A * | 6/1994 | Subera | F25B 47/022 62/196.4 |
| 5,357,767 | A | 10/1994 | Roberts | |
| 5,507,340 | A * | 4/1996 | Alston | F28D 1/0477 165/150 |
| 5,531,078 | A | 7/1996 | Day et al. | |
| 5,765,393 | A | 6/1998 | Shlak et al. | |
| 6,038,875 | A * | 3/2000 | Haselden | F25B 41/065 62/218 |
| 6,109,044 | A * | 8/2000 | Porter | F24F 1/0059 165/104.21 |
| 6,125,648 | A * | 10/2000 | Hill | F04F 3/00 62/471 |
| 6,655,170 | B2 | 12/2003 | Holz et al. | |
| 7,104,079 | B2 | 9/2006 | Kuwabara et al. | |
| 2003/0131618 | A1 | 7/2003 | Doi et al. | |
| 2006/0054614 | A1 * | 3/2006 | Baxter | A23G 9/045 219/400 |
| 2006/0236716 | A1 * | 10/2006 | Griffin | F25B 5/04 62/503 |
| 2006/0288713 | A1 | 12/2006 | Knight et al. | |
| 2007/0144190 | A1 | 6/2007 | Temmyo et al. | |
| 2008/0104974 | A1 * | 5/2008 | Dieckmann | F24F 3/153 62/93 |
| 2008/0289354 | A1 | 11/2008 | Dudley et al. | |
| 2010/0107683 | A1 * | 5/2010 | MacBain | F25B 1/00 62/510 |

* cited by examiner

COOLING SYSTEM HAVING DUAL SUCTION PORT COMPRESSOR

CROSS-REFERENCE TO RELATED APPLICATION

This application is a continuation of U.S. patent application Ser. No. 13/780,706, filed Feb. 28, 2013, and entitled "REFRIGERATION SYSTEM HAVING DUAL SUCTION PORT COMPRESSOR," the entire disclosure of which is incorporated herein by reference.

STATEMENT REGARDING FEDERALLY SPONSORED RESEARCH AND DEVELOPMENT

This invention was made with government support under Award No. DE-EE0003910, awarded by the U.S. Department of Energy. The government has certain rights in the invention.

BACKGROUND OF THE INVENTION

Known cooling systems for refrigerators, freezers, air conditioners and the like include a compressor, a condenser, and expander such as a capillary tube, and an evaporator. These components are interconnected utilizing elongated conduits, whereby compressed refrigerant flows from the compressor through the condenser, the expander, the evaporator, and then into the compressor. Known systems commonly include a single fluid conduit forming a loop whereby the refrigerant flows in a single stream through the various components of the system.

However, known systems suffer from various drawbacks, and may not provide optimum efficiency.

BRIEF SUMMARY OF THE INVENTION

One aspect of the present invention is a cooling system configured so as to cool a space. The space may comprise an insulated space in a refrigerator or other such appliance. The cooling system includes a compressor, and a condenser that receives refrigerant flowing from the compressor. The system further includes an evaporator that receives refrigerant flowing from the condenser. The evaporator defines upstream and downstream portions, and refrigerant received from the condenser flows through the upstream portion of the evaporator. A first portion of the refrigerant flows to the compressor without passing through the downstream portion of the evaporator, and a second portion of the refrigerant from the upstream portion of the condenser flows through the downstream portion of the evaporator after passing through the upstream portion of the evaporator. The second portion of the refrigerant flows to the compressor after passing through the downstream portion of the evaporator.

The compressor may include first and second suction ports that receive the first and second portions, respectively, of the refrigerant. The first suction port may comprise a high suction port of the compressor, and the second suction port may comprise a low pressure suction port. The high pressure suction port of the compressor pulls the refrigerant vapor out of the evaporator and into the compressor, and the remaining liquid refrigerant passes through a downstream portion of the evaporator. A second expander such as a capillary tube may be utilized to expand the liquid refrigerant that has passed through the upstream portion of the evaporator prior to passing the refrigerant through the downstream portion of the evaporator.

The evaporator may comprise to separate units with a conduit extending between the two units, and wherein a T-junction splits the conduit between the upper and lower evaporator units. Alternately, the upstream and downstream portions of the evaporator may be interconnected by a rigid structure whereby the upstream and downstream portions of the evaporator form a single unit that can be moved prior to mounting the evaporator unit to a refrigerator, freezer, or the like.

These and other features, advantages, and objects of the present invention will be further understood and appreciated by those skilled in the art by reference to the following specification, claims, and appended drawings.

DETAILED DESCRIPTION

Figure 1:
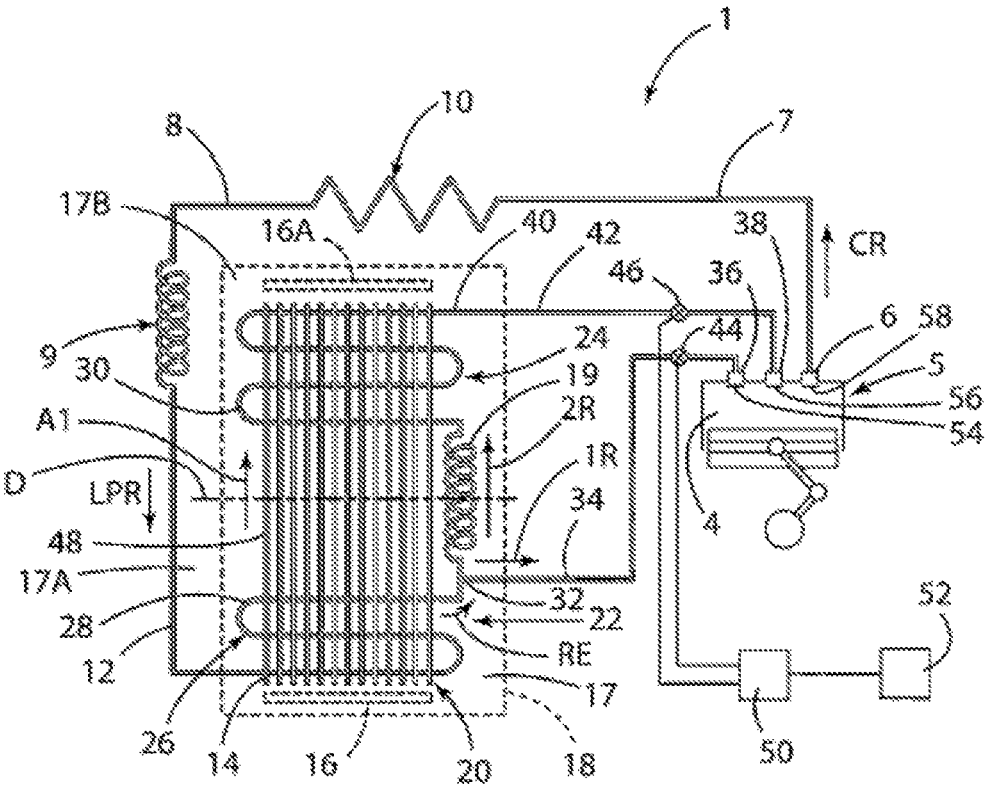
FIG. 1 is a schematic view of a cooling system according to one aspect of the present invention.

For purposes of description herein, the terms "upper," "lower," "right," "left," "rear," "front," "vertical," "horizontal," and derivatives thereof shall relate to the invention as oriented in the drawing. However, it is to be understood that the invention may assume various alternative orientations, except where expressly specified to the contrary. It is also to be understood that the specific devices and processes illustrated in the attached drawing, and described in the following specifications are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to the drawing, a cooling system 1 according to one aspect of the present invention includes a compressor 5, a condenser 10, and an evaporator 20. Compressor 5 includes an exit port 6 that is fluidly connected to condenser 10 by a conduit 7. Compressed refrigerant "CR" flows from the compressor 5 to the condenser 10, and then flows through a conduit 8 to an expander such as capillary tube 9. The capillary tube 9 and condenser 10 may comprise known units of a conventional construction as required for a particular application. The capillary tube 9 may also comprise a valve, or other device that lowers pressure of the refrigerant in a known manner.

The lower pressure refrigerant ("LPR") flows from capillary tube 9 to an inlet 14 of evaporator 20 through a conduit 12. Evaporator 20 includes an upstream portion 22 and a downstream portion 24. A conduit 26 provides for flow of refrigerant through the upstream and downstream portions 22 and 24, respectively, of evaporator 20. Conduit 26 includes an upstream portion 28 and a downstream portion 30. A T-joint 32 in conduit 26 splits the stream of refrigerant "RE" into a first portion "1R" that flows through a conduit 34, and a second portion "2R" that flows through downstream portion 30 of conduit 26. The second portion 2R of the coolant flows through an optional second expander such as a capillary tube 19, and then through downstream portion 30 of conduit 26 of downstream portion 24 of evaporator 20. The refrigerant then flows from outlet 40 of downstream portion 24 of evaporator 20 through conduit 42. Compressor 5 includes first and second suction or inlet ports 36 and 38 that draw refrigerant from evaporator 20 through conduits 34 and 42, respectively. First and second valves 44 and 46 in conduits 34 and 42, respectively are connected to a controller 50. Compressor 5 and controller 50 may be operably connected to an electrical power source 52.

In the illustrated example, the upstream and downstream portions 22 and 24, respectively, of evaporator 20 are interconnected by a structure 48 that may comprise a plurality of heat exchanger fins or other heat exchanger surface or feature. Structure 48 may be configured such that evaporator 20 forms a single unit that can be installed to a refrigerator 18 or other appliance to cool an insulated space 17. However, in most applications the heat exchanger fins 48 are not designed to structurally support the evaporator 20 or to structurally interconnect parts of the evaporator 20. A fan 16 generates an airstream "A1" that flows over both the upstream and downstream portions 22 and 24, respectively. Alternately, the upstream and downstream portions 22 and 24, respectively, of evaporator 22 may comprise separate evaporator structures that are separated as shown schematically by the line "D." The upstream and downstream portions 22 and 24 may be located in two separated insulated spaces 17A and 17B, respectively, that are separated by an insulated wall. Line D could comprise an insulated wall if configured in this way. A second fan 16A may be utilized to generate a second stream of air that flows over downstream portion 24 of evaporator 20 in space 17B.

In use, refrigerant from expander/capillary tube 9 enters the upstream portion 28 of conduit 26 as a single stream of refrigerant. As the refrigerant flows through the upstream portion 22 of evaporator 20, the vapor quantity of the refrigerant increases as it absorbs heat. The conduit 26 thus becomes less and less flooded with liquid refrigerant along the refrigerant flow path of upstream portion 28 of conduit 26. Because the internal surface of conduit 26 is in contact with less fluid as the amount of vapor increases, the amount of heat transferred into the refrigerant is reduced along the upstream portion 28 of conduit 26.

In order to improve the transfer of heat, T-joint 32 is utilized to separate the refrigerant vapor, which is pulled into first inlet port 36 of compressor 5. The first port 36 comprises a high pressure suction port of the compressor that provides greater vacuum relative to second inlet port 38.

The refrigerant that is not split off at T-joint 32 flows through downstream portion 24 of evaporator 20 through downstream portion 30 of conduit 26. Because much of the refrigerant in vapor form is separated at T-joint 32, the second stream of refrigerant 2R contains a higher percentage of liquid refrigerant than the refrigerant RE entering T-joint 32. The second stream 2R of refrigerant may pass through a second expander such as capillary tube 19 before passing through the downstream portion 30 of conduit 26. This reduces the pressure of the refrigerant such that the refrigerant in downstream portion 30 of conduit 26 has a lower pressure than refrigerant in upstream portion 28 of conduit 26. The second portion 2R of the stream of refrigerant exits the downstream portion 24 of evaporator 20 at exit 40, and flows into low pressure second inlet port 38 of compressor 5.

Compressor 5 is configured to provide different pressure levels between the inlet ports 36 and 38 as required for a particular application. The suction ports 36 and 38 can preferably open and close independently and operate at different pressure levels. Valves 54 and 56 may be positioned at ports 36 and 38, respectively, and valve 58 may be positioned at outlet port 6 of compressor 5. Valves 54 and 56 may comprise spring-biased valves that open if a predefined vacuum level (pressure differential) exists between internal space 4 of compressor 5 and conduits 34 and 42. Similarly, valve 58 may be configured to open and allow flow into conduit 7 if sufficient pressure is developed in internal space 4 of compressor 5. The spring constants, valve sizes, and other factors can be varied such that valves 54, 56, and 58 open at the required predefined vacuums. Also, valves 54, 56, and 58 may be operably connected to controller 50 such that the opening vacuum and/or timing of valves 54, 56, and 58 can be controlled during operation to account for varying operating conditions. Valves 44 and 46 can also be utilized to control the flow of refrigerant into first and second ports 36 and 38 of compressor 5.

Figure 2:
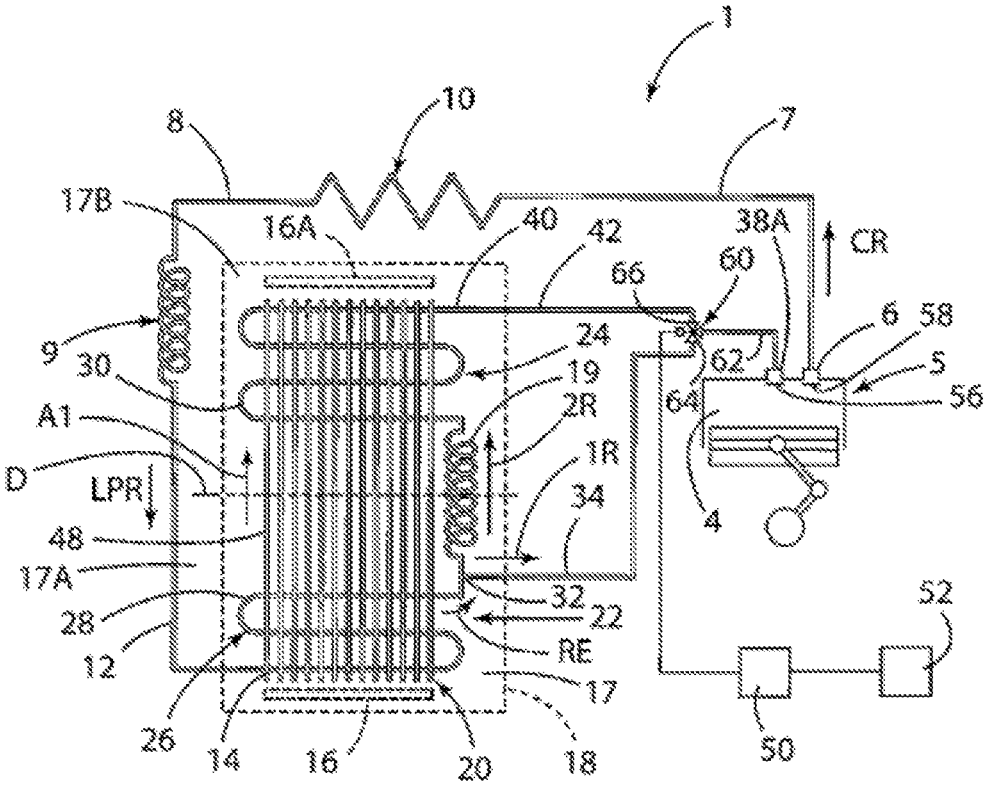
FIG. 2 shows a cooling system according to another aspect of the present invention.

With further reference to FIG. 2, port 38A may comprise a single port that is connected to a three-way valve 60 by a conduit or line 62. Three-way valve 60 includes first and second input ports 64 and 66, respectively, that are connected to conduits 34 and 42, respectively. Output port 68 of three-way valve 60 is connected to conduit 62. The three-way valve 60 comprises a powered solenoid valve that is operably coupled to controller 50.

In use, three-way valve 60 is controlled to provide the required amount of suction on conduits 34 and 42 at the proper times. It will be understood that the operation of three-way valve 60 may be controlled based, at least in part, on a measured temperature inside appliance 18, a measured ambient temperature, measured temperatures at various points, of refrigerant in the system and/or the vacuum/pressure levels within the system, as well as a desired (preset) target temperature for the space inside of appliance 18.

In the illustrated example, the evaporator 20 includes an upstream portion 22 and a downstream portion 24. It will be understood, however, that three or more portions may be utilized in conjunction with a compressor having three or more suction ports if required for a particular application. Furthermore, as discussed above, the upstream and downstream portions 22 and 24 of evaporator 20 may be rigidly interconnected by a structure 48 to form a single unit whereby the upstream and downstream portions 22 and 24 can be simultaneously installed or secured to a refrigerator 18 or other component. Alternately, the upstream and downstream portions 22 and 24 of evaporator 20 may comprise separate units that are fluidly interconnected by conduit 26 in operation, but may comprise structurally separate units that can be moved and installed separately.

Figure 3:
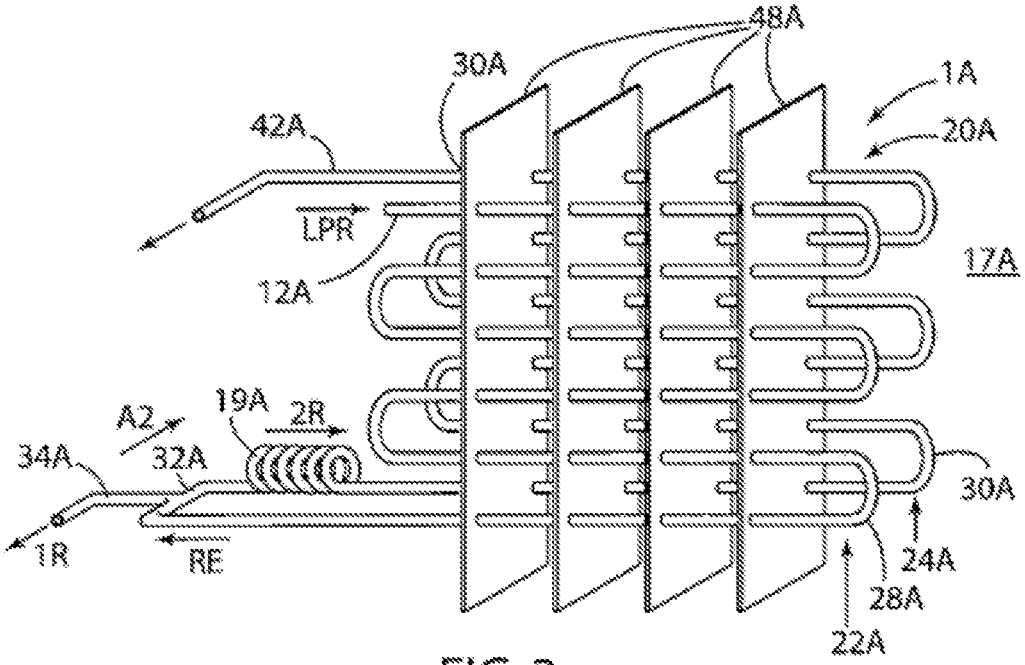
FIG. 3 is a partially fragmentary view of an evaporator according to another aspect of the present invention.

With further reference to FIG. 3, a cooling system 1A according to another aspect of the present invention includes an evaporator 20A having an upstream or front conduit 28A and a downstream or rear conduit 30A. The conduits 28A and 30A are connected to cooling fins 48A. Low pressure refrigerant "LPR" from a condenser 10 (not shown in FIG. 3) flows into evaporator 20A along a conduit 12A corresponding to the conduit 12 described in more detail above in connection with FIG. 1. Refrigerant "RE" flows to a T-shaped joint 32A and a portion of the refrigerant splits off and flows through conduit 34A to form a stream 1R that flows to compressor 5 (not shown in FIG. 3). As discussed in more detail above in connection with FIGS. 1 and 2, the compressor may comprise a multi port unit (FIG. 1) or a single port unit having an inlet fluidly connected to a 3-way valve (FIG. 2). A second stream or portion "2R" of the refrigerant passes through an optional capillary tube 19A, and then through downstream conduit 30A. Refrigerant flowing out of conduit 30A flows through a conduit 42A back to the compressor 5 as described in more detail above.

Airflow "A2" passes over the fins 48A such that the air is cooled. The evaporator 20A operates in substantially the same manner as the evaporator 20 described in more detail above in connection with FIG. 1. However, evaporator 20A has a configuration that is suitable for use if the cooling system comprises an air conditioning unit. Accordingly, the space 17A of FIG. 3 may comprise an interior space of a building, vehicle, or other space to be cooled.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A cooling system configured so as to cool an interior space, the cooling system comprising:

a compressor;

a condenser that receives refrigerant flowing from the compressor;

an evaporator that receives refrigerant flowing from the condenser, the evaporator defining upstream and downstream portions, and wherein refrigerant received from the condenser flows through the upstream portion of the evaporator, a first portion of the refrigerant flowing to the compressor without passing through the downstream portion of the evaporator, a second portion of the refrigerant from the upstream portion flowing through the downstream portion of the evaporator after passing through the upstream portion of the evaporator, the second portion of the refrigerant flowing to the compressor after passing through the downstream portion of the evaporator;

a refrigerant expander operably coupled to the condenser and the evaporator and permitting expansion of refrigerant flowing from the condenser to the evaporator.

2. The cooling system of claim 1, wherein:

the compressor includes first and second suction ports that receive the first and second portions, respectively, of the refrigerant.

3. The cooling system of claim 2, wherein:

refrigerant enters the compressor through the first suction port at a first pressure, and refrigerant enters the compressor through the second suction port at a second pressure that is significantly greater or less than the first pressure.

4. The cooling system of claim 3, wherein:

the compressor includes an outlet port that is operably connected to the first and second input ports, and wherein the compressor combines and compresses refrigerant from the first and second suction ports and the combined refrigerant is at a single pressure when flowing from the outlet port.

5. The cooling system of claim 2, wherein:

the first suction port is connected to the downstream portion of the evaporator by a first elongated conduit, and the second suction port is connected to the evaporator between the upstream and downstream portion by a second elongated conduit.

6. The cooling system of claim 5, including:

first and second valves controlling flow of refrigerant through the first and second elongated conduits, respectively.

7. The cooling system of claim 6, wherein:

the evaporator includes upstream and downstream elongated conduits extending through the upstream and downstream portions, respectively, of the evaporator.

8. The cooling system of claim 7, including:

a secondary refrigerant expander that expands the second portion of the refrigerant after it passes through the upstream elongated conduit, but before the second portion of the refrigerant passes through the downstream conduit.

9. The cooling system of claim 1, including:

a three-way valve having first and second input ports that receive the first and second portions, respectively, of the refrigerant, and an outlet port fluidly connected to the compressor.

10. The cooling system of claim 1, wherein:

the upstream and downstream portions of the evaporator are not directly interconnected structurally whereby the upstream and downstream portions of the evaporator can be moved relative to one another prior to mounting the upstream and downstream portions to a refrigerator structure.

11. The cooling system of claim 1, wherein:

the upstream and downstream portions of the evaporator comprise upstream and downstream conduits, respectively, wherein the upstream and downstream conduits each include a plurality of linear portions that are interconnected by U-shaped bends, wherein the linear portions of the upstream conduits are disposed in a first plane, and the linear portions of the downstream conduits are disposed in a second plane that is spaced apart from the first plane and parallel to the first plane.

12. The cooling system of claim 11, wherein:

the evaporator includes a plurality of fins connected to the upstream and downstream conduits whereby the upstream and downstream conduits are interconnected by the fins.

13. The cooling system of claim 12, wherein:

the cooling system comprises an air conditioning unit.

14. A cooling system comprising:

a compressor having first and second suction ports that are operably connected to an outlet port so as to compress refrigerant as it flows from the first and second suction ports to the outlet port;

a condenser receiving refrigerant flowing from the outlet port of the compressor;

an evaporator having an upstream portion having an inlet receiving refrigerant flowing from the condenser, and an outlet, and wherein the evaporator includes a downstream portion having an inlet portion and an outlet portion;

a passageway interconnecting the condenser to the inlet of the upstream portion of the evaporator, the passageway having at least a portion thereof that is configured so as to provide for expansion of refrigerant flowing from the condenser to the evaporator;

a passageway providing flow of refrigerant through the upstream and downstream portions of the evaporator, the passageway splitting off at least a first portion of the refrigerant that has passed through the upstream portion of the evaporator such that the first portion of the refrigerant flows to the first suction port of the compressor from the upstream portion of the evaporator without passing through the downstream portion of the evaporator, the passageway providing flow of a second portion of the refrigerant through the downstream portion of the evaporator after the refrigerant has passed through the upstream portion of the evaporator;

and wherein the passageway provides for flow of refrigerant from the downstream portion of the evaporator to the second suction port of the compressor whereby the second portion of the refrigerant is compressed and flows out of the outlet port.

15. The cooling system of claim 14, wherein:

the elongated conduit includes a T-junction between the outlet of the upstream portion of the evaporator and the inlet of the downstream portion of the evaporator, the T-junction splitting flow of refrigerant into the first and second portions.

16. The cooling system of claim 15, wherein:

the elongated conduit comprises first and second downstream portions coupled to the inlet and outlet ports, respectively, of the compressor; and including:

first and second valves operably connected to the first and second downstream portions, respectively, of the elongated conduit and controlling flow of refrigerant through the first and second downstream portions, respectively, of the elongated conduits.

17. The cooling system of claim 14, including:

a structure rigidly interconnecting the upstream and downstream portions of the evaporator.

18. A method of cooling a space, the method comprising:

causing a stream of compressed refrigerant to flow through a condenser, whereby a temperature of the compressed refrigerant is reduced;

cooling the refrigerant by reducing a pressure of the refrigerant;

causing a stream of the cooled refrigerant to flow through a first evaporator conduit and absorb heat after a pressure of the refrigerant is reduced;

splitting the stream of refrigerant into first and second portions after the refrigerant flows through the first evaporator conduit;

causing the second portion of the stream of refrigerant to flow through a second evaporator conduit and absorb heat;

compressing the first and second portions of the stream of refrigerant;

combining the first and second portions of the stream of refrigerant to form a single stream of compressed refrigerant.

19. The method of claim 18, including:

causing the first and second portions of the stream of refrigerant to have first and second pressures that are not equal.

20. The method of claim 19, including:

providing first and second valves;

utilizing the first and second valves to control flow of the first and second portions, respectively, of the stream of refrigerant after exiting the evaporator and before compression.

* * * * *